US008967072B2

(12) United States Patent
Chen

(10) Patent No.: US 8,967,072 B2
(45) Date of Patent: Mar. 3, 2015

(54) RETRACTABLE FLAGPOLE ASSEMBLY

(76) Inventor: Wu-Tsung Chen, Tainan (TW)

( * ) Notice: Subject to any disclaimer, the term of this patent is extended or adjusted under 35 U.S.C. 154(b) by 387 days.

(21) Appl. No.: 13/485,935

(22) Filed: Jun. 1, 2012

(65) Prior Publication Data

US 2013/0319315 A1 Dec. 5, 2013

(51) Int. Cl.
*G09F 17/00* (2006.01)
*E04H 12/32* (2006.01)

(52) U.S. Cl.
USPC ..... 116/173; 116/174

(58) Field of Classification Search
CPC ..... G09F 17/00; G09F 17/0091; G09F 2017/0025; G09F 2017/005; G09F 2017/0058; E04H 12/32
USPC ..... 116/173, 174, 175; 40/607.04, 607.05, 40/607.06, 607.08, 607.14; 248/511, 519, 248/530
See application file for complete search history.

(56) References Cited

U.S. PATENT DOCUMENTS 483,420 A * 9/1892 Brown ..... 116/173
2,368,783 A * 2/1945 Schillinger ..... 116/174
2,926,442 A * 3/1960 Reimel ..... 40/607.11
3,595,202 A * 7/1971 Visitacion ..... 116/174
4,662,305 A * 5/1987 Cline ..... 116/173
5,044,301 A * 9/1991 Peters et al. ..... 116/174
5,522,342 A * 6/1996 Chen-Chao ..... 116/174
5,540,181 A * 7/1996 Pearce ..... 116/173
8,567,337 B2 * 10/2013 Chen ..... 116/174
2004/0031433 A1 * 2/2004 Cardarelli ..... 116/174
2006/0086308 A1 * 4/2006 Chen ..... 116/174
2011/0162575 A1 * 7/2011 Jahnz ..... 116/173
2013/0042800 A1 * 2/2013 Chen ..... 116/173

FOREIGN PATENT DOCUMENTS

FR 2987389 A1 * 8/2013 ..... G09F 17/00

* cited by examiner

*Primary Examiner* — R. A. Smith
(74) *Attorney, Agent, or Firm* — Raymond Y. Chan; David and Raymond Patent Firm

(57) ABSTRACT

A retractable flagpole assembly includes a retractable flagpole, a top pivot holder rotatably capped on the top rod of the retractable flagpole and provided with a hanging lug for securing an inner top end of a flag, an end block spaced below the lower pivot holder and provided with a hanging lug for securing an inner bottom end of the flag, a link coupled between the top pivot holder and the end block, and a lower pivot holder rotatably sleeved onto the retractable flagpole and axially movable along the link and lockable to the end block.

12 Claims, 13 Drawing Sheets

RETRACTABLE FLAGPOLE ASSEMBLY

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to flagpoles and more particularly, to a retractable flagpole assembly, which can be set between an extended operative position and a received non-operative position and, which prevents the flag from tangling on the flagpole.

2. Description of Related Arts

A conventional flagpole is known having two receiving portions disposed at different elevations at the top side thereof for the fastening of the top and bottom corners of the fixation end (opposite to the fly end) of a flag. This arrangement cannot prevent the flag from tangling on the flagpole when the flag is flying in the breeze. To avoid the tangled flag problem, a tangle free flagpole is known using two or three swivel pivot holders to secure the flag to the flagpole and a link to link the swivel pivot holders. When the flag is flying in the breeze, the swivel pivot holders can be synchronously turned with the link about the flagpole, preventing the flag from tangling on the flagpole. Taiwan Patent M263591 discloses a similar design. However, this design does not allow the use of a retractable pole. If a retractable pole consisting of multiple parts is used, the swivel pivot holders shall have to be fastened to the top piece of the multiple parts of the retractable pole, however, the swivel pivot holders will become a barrier to stop the top piece of the multiple parts of the retractable pole from being inserted into the inside of the other parts. Therefore, this problem must be settled.

SUMMARY OF THE PRESENT INVENTION

The present invention has been accomplished under the circumstances in view. It is one object of the present invention to provide a retractable flagpole assembly, which is retractable and can prevent the flat from tangling.

To achieve this and other objects of the present invention, a retractable flagpole assembly comprises a retractable flagpole, a top pivot holder rotatably capped on the top rod of the retractable flagpole and provided with a hanging lug for securing an inner top end of a flag, an end block spaced below the lower pivot holder and provided with a hanging lug for securing an inner bottom end of the flag, a link coupled between the top pivot holder and the end block, and a lower pivot holder rotatably sleeved onto the retractable flagpole and axially movable along the link and lockable to the end block.

Further, the top pivot holder comprises an axle sleeve vertically disposed at one lateral side thereof. The axle sleeve comprises an axial through hole extending through opposing top and bottom ends thereof. The axial through hole of the axle sleeve of the top pivot holder comprises an upper crossed hole portion, a lower flat hole portion, and a stop edge defined between the upper crossed hole portion and the lower flat hole portion. The link comprises a flat top end portion vertically upwardly inserted through the axial through hole of the axle sleeve of the top pivot holder and stopped at the top side of the stop edge of the axle sleeve of the top pivot holder after a rotary motion of the link relative to the top pivot holder.

Further, an upper end plug is plugged in the upper crossed hole portion of the axial through hole of the axle sleeve of the upper pivot holder.

Further, the end block comprises an axial through hole extending through opposing top and bottom ends thereof. The axial through hole of the end block comprising a lower crossed hole portion, an upper flat hole portion, and a stop edge defined between the lower crossed hole portion and the upper flat hole portion. The link further comprises a flat bottom end portion vertically upwardly inserted through the axial through hole of the end block and stopped at the bottom side of the stop edge of the end block after a rotary motion of the link relative to the end block.

Further, a lower end plug is plugged in the lower crossed hole portion of the axial through hole of the end block.

The retractable flagpole assembly further comprises an anchor. The anchor comprises a round tube fastened to the bottom end of the retractable flagpole, an angle plate fixedly fastened to the bottom end of the round tube and terminating in a pointed portion for fastening into the ground, and a force-applying portion perpendicularly extended from an upper part of the angle plate for operation by hand or foot or hammer.

Further, the lower pivot holder comprises a tubular body sleeved onto the retractable flagpole, and locking means adapted to lock the link to the tubular body.

Further, the lower pivot holder comprises a tubular body sleeved onto the retractable flagpole. The locking means comprises two fixed sleeve components fixedly connected to the periphery of the tubular body at different elevations and sleeved onto the link, and a movable sleeve component coupled between the two fixed sleeve components and sleeved onto the link and rotatable relative to the two fixed sleeve components and the link between a locking position to lock the link to the tubular body and an unlocking position for allowing the lower pivot holder to be moved axially relative to the link.

Further, the movable sleeve component comprises an eccentric hole extending through opposing top and bottom ends thereof for the passing of the link. The movable sleeve component is forced into friction engagement with the periphery of the link and the periphery of the tubular body when moved to the locking position.

The retractable flagpole assembly further comprises a first coupling means located on the bottom end of the lower pivot holder, and a second coupling means located on the top end of the end block and detachably engageable with the first coupling means.

In one embodiment, the first coupling means comprises at least one coupling groove, and the second coupling means comprises at least one coupling block detachably engageable with the at least one coupling groove.

In another embodiment, the first coupling means comprises at least one coupling block, and the second coupling means comprises at least one coupling groove detachably engageable with the at least one coupling block.

DETAILED DESCRIPTION OF THE PREFERRED EMBODIMENT

Figure 1:
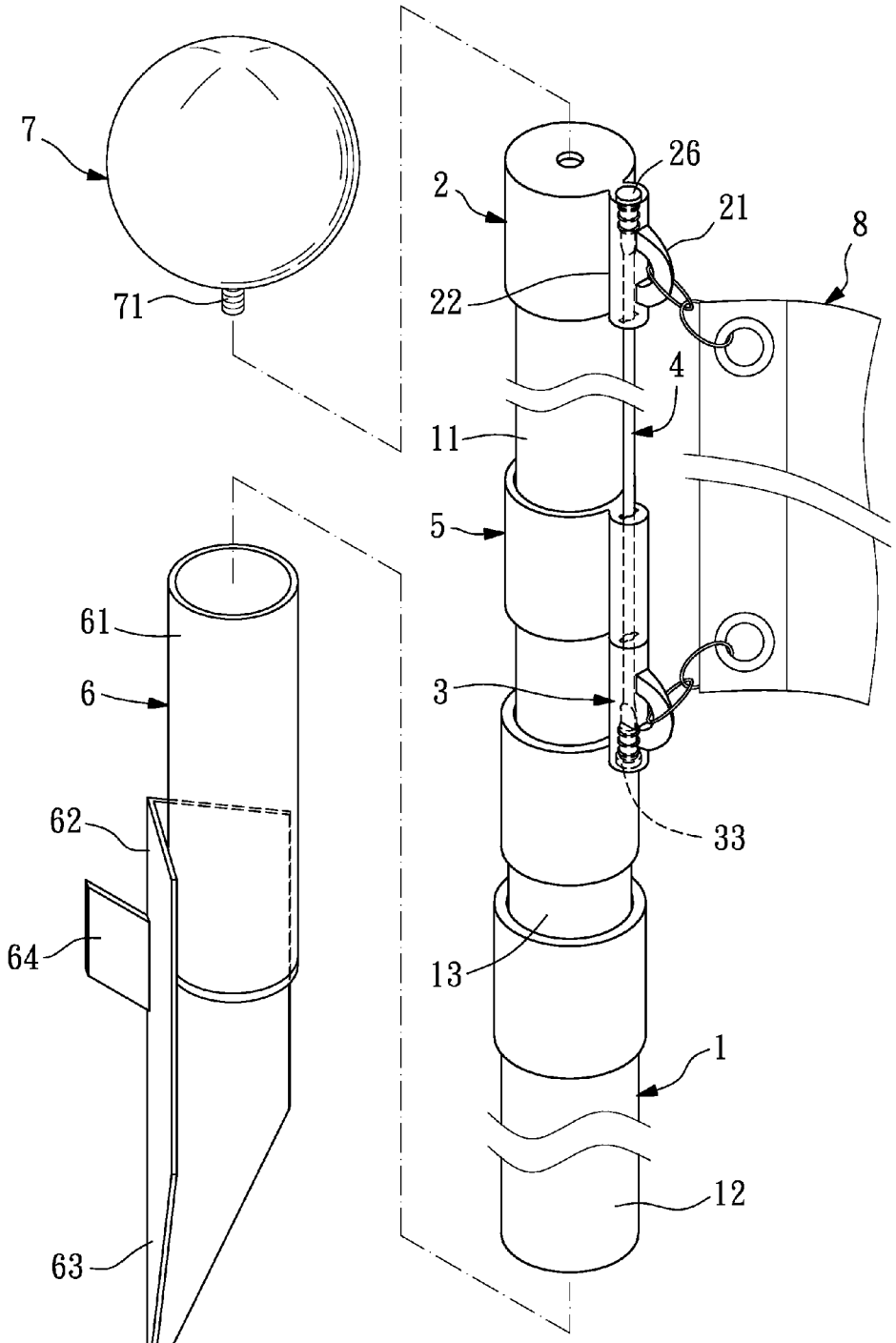
FIG. 1 is a perspective exploded view of a retractable flagpole assembly in accordance with the present invention.

Referring to FIG. 1, a retractable flagpole assembly in accordance with the present invention is shown. The flagpole assembly comprises a retractable flagpole 1, a top pivot holder 2, an end block 3, a link 4, a lower pivot holder 5, and an anchor 6.

Figure 2:
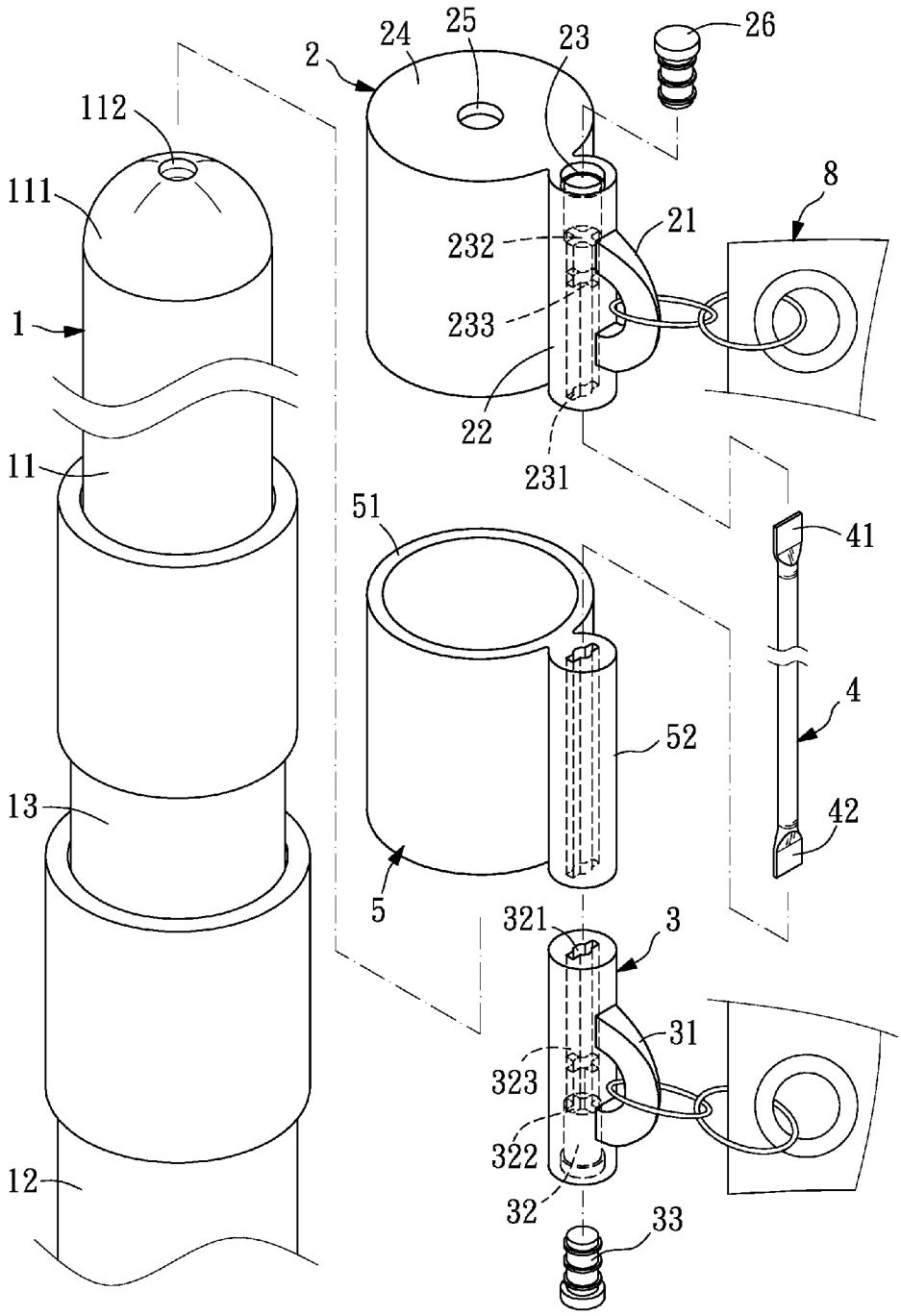
FIG. 2 is a perspective exploded view of the flagpole assembly in accordance with the present invention.
Figure 3:
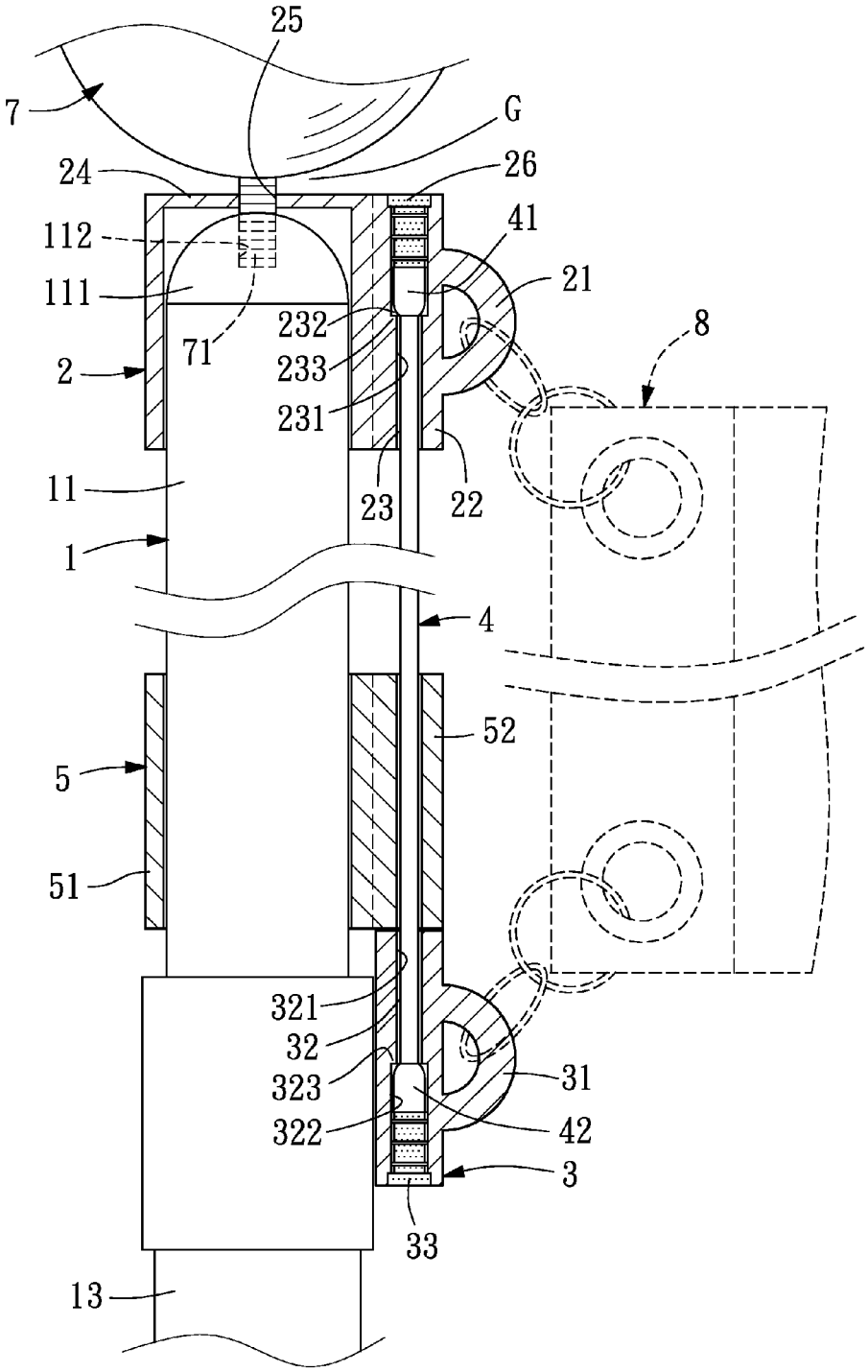
FIG. 3 is a schematic sectional assembly view of a part of the flagpole assembly in accordance with the present invention.

The retractable flagpole 1 is an adjustable in length, comprising a top rod 11, an intermediate rod 13 and a bottom rod 12 (see FIG. 1 and FIG. 2). The top rod 11 has a rounded top end 111, and a top screw hole 112 located at the center of the rounded top end 111 for the fastening of a bottom screw rod 71 of a finial 7 (see FIG. 3).

The top pivot holder 2 is a hollow cylindrical cap member rotatably capped on the rounded top end 111 of the flagpole 1 (see FIG. 3), comprising a flat top end wall 24 supported on the rounded top end 111 of the flagpole 1, a top through hole 25 cut through the flat top end wall 24 at the center for the passing of the bottom screw rod 71 of the finial 7, an axle sleeve 22 vertically disposed at one lateral side thereof, and a hanging lug 21 formed integral with the periphery of the axle sleeve 22 for the fastening of an upper hook member of a flag 8. The axle sleeve 22 defines an axial through hole 23 (see FIG. 2). The axial through hole 23 comprises an upper crossed hole portion 232, a lower flat hole portion 231, and a stop edge 233 defined between the upper crossed hole portion 232 and the lower flat hole portion 231. Further, after installation of the bottom screw rod 71 of the finial 7 in the top through hole 25 of the top pivot holder 2, a gap G is left between the finial 7 and the flat top end wall 24 of the top pivot holder 2, allowing free rotation of the top pivot holder 2 relative to the retractable flagpole 1 (see FIG. 3).

The end block 3 comprises a hanging lug 31 formed integral with the periphery thereof for the fastening of a lower hook member of the flag 8 (see FIG. 2), and an axial through hole 32 extending through opposing top and bottom ends thereof. The axial through hole 32 comprises a lower crossed hole portion 322, an upper flat hole portion 321, and a stop edge 323 defined between the lower crossed hole portion 322 and the upper flat hole portion 321.

The link 4 is coupled between the top pivot holder 2 and the end block 3, comprising a flat top end portion 41 and a flat bottom end portion 42 (see FIG. 2). The flat top end portion 41 and flat bottom end portion 42 of the link 4 are disposed on the same plane. The flat top end portion 41 of the link 4 is upwardly inserted through the lower flat hole portion 231 and upper crossed hole portion 232 of the axial through hole 23 of the top pivot holder 2, and then the link 4 is rotated through an angle relative to the top pivot holder 2, enabling the flat top end portion 41 of the link 4 to be stopped at the top side of the stop edge 233 in the axial through hole 23 of the top pivot holder 2 (see FIG. 3). The flat bottom end portion 42 of the link 4 is downwardly inserted through the upper flat hole portion 321 and lower crossed hole portion 322 of the axial through hole 32 of the end block 3, and then the end block 3 is rotated through an angle relative to the link 4, enabling the flat bottom end portion 42 of the link 4 to be stopped at the bottom side of the stop edge 323 in the axial through hole 32 of the end block 23 (see FIG. 3) to hold the end block 3 in place. Thereafter, an upper end plug 26 and a lower end plug 33 are respectively fastened to the axial through hole 23 of the top pivot holder 2 and the axial through hole 32 of the end block 3 to prevent displacement of the link 4 relative to the top pivot holder 2 or the end block 3.

Figure 4:
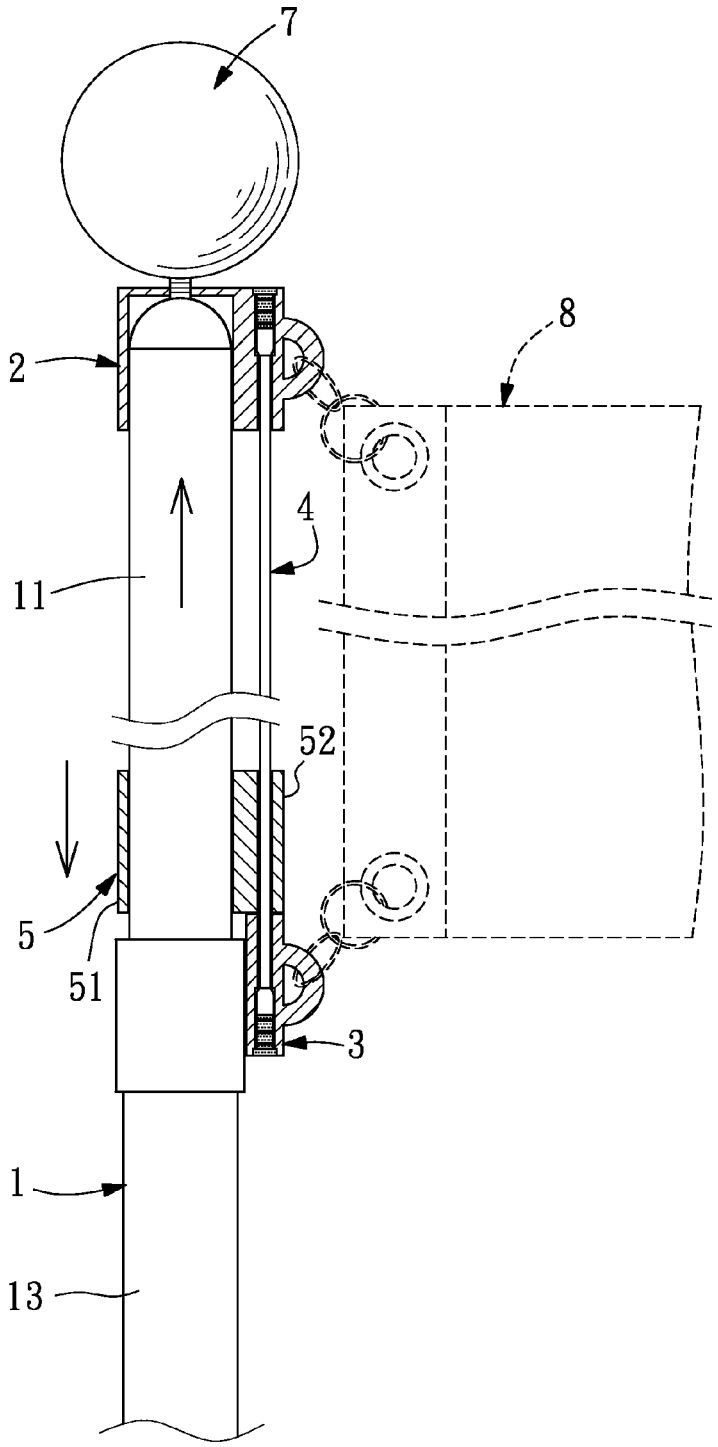
FIG. 4 is a schematic sectional view of the present invention, illustrating the flagpole adjusted from the received non-operative condition to the extended operative condition.

The lower pivot holder 5 comprises a tubular body 51 sleeved onto the retractable flagpole 1, and an axle sleeve 52 vertically formed integral with the periphery of the tubular body 51. The link 4 is inserted through the axle sleeve 52 of the lower pivot holder 5 before connection between the link 4 and the top pivot holder 2 or end block 3. After installation, the lower pivot holder 5 is coupled to the link 4 and axially movable along the link 4 between the top pivot holder 2 and the end block 3 (see FIG. 4).

Figure 5:
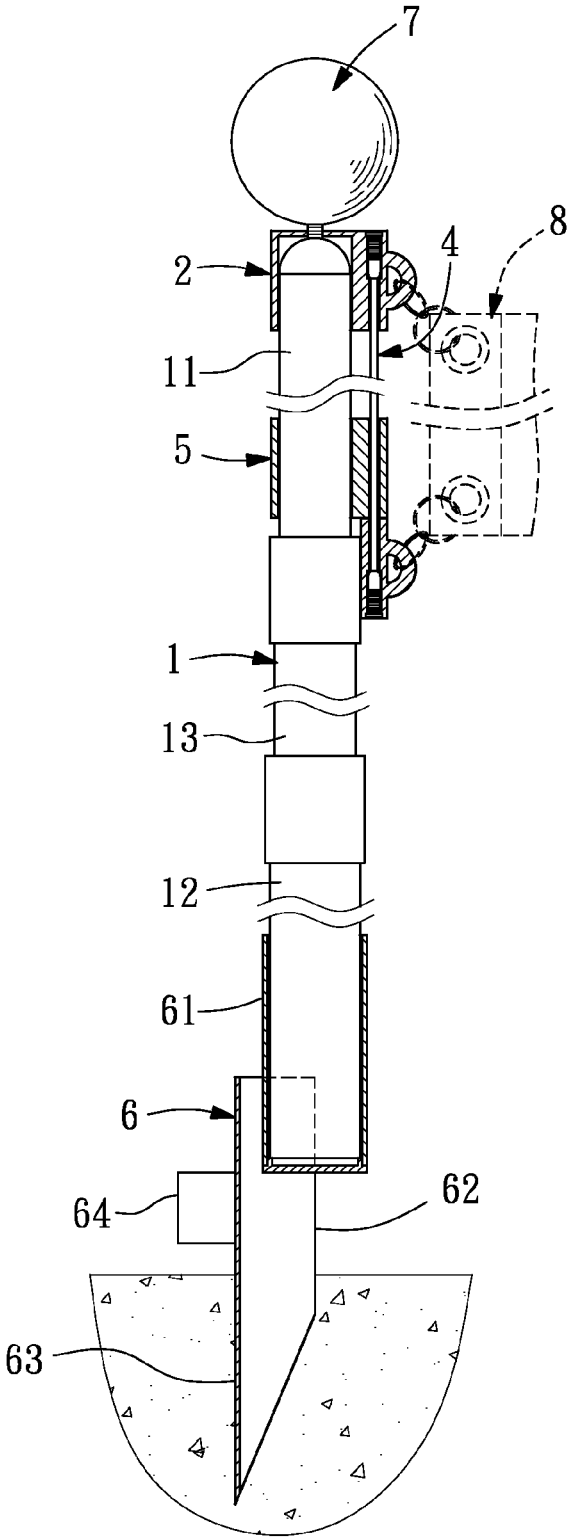
FIG. 5 is a schematic sectional applied view of the present invention, illustrating the anchor of the flagpole assembly fastened to the ground.

The anchor 6 comprises a round tube 61 (see FIG. 1), and an angle plate 62 fixedly fastened to the bottom end of the round tube 61 and terminating in a pointed portion 63 for fastening to the ground (see FIG. 5), and a force-applying portion 64 perpendicularly extended from an upper part of the angle plate 62 for operation by hand or foot or hammer to fasten the pointed portion 63 into the ground.

Figure 6:
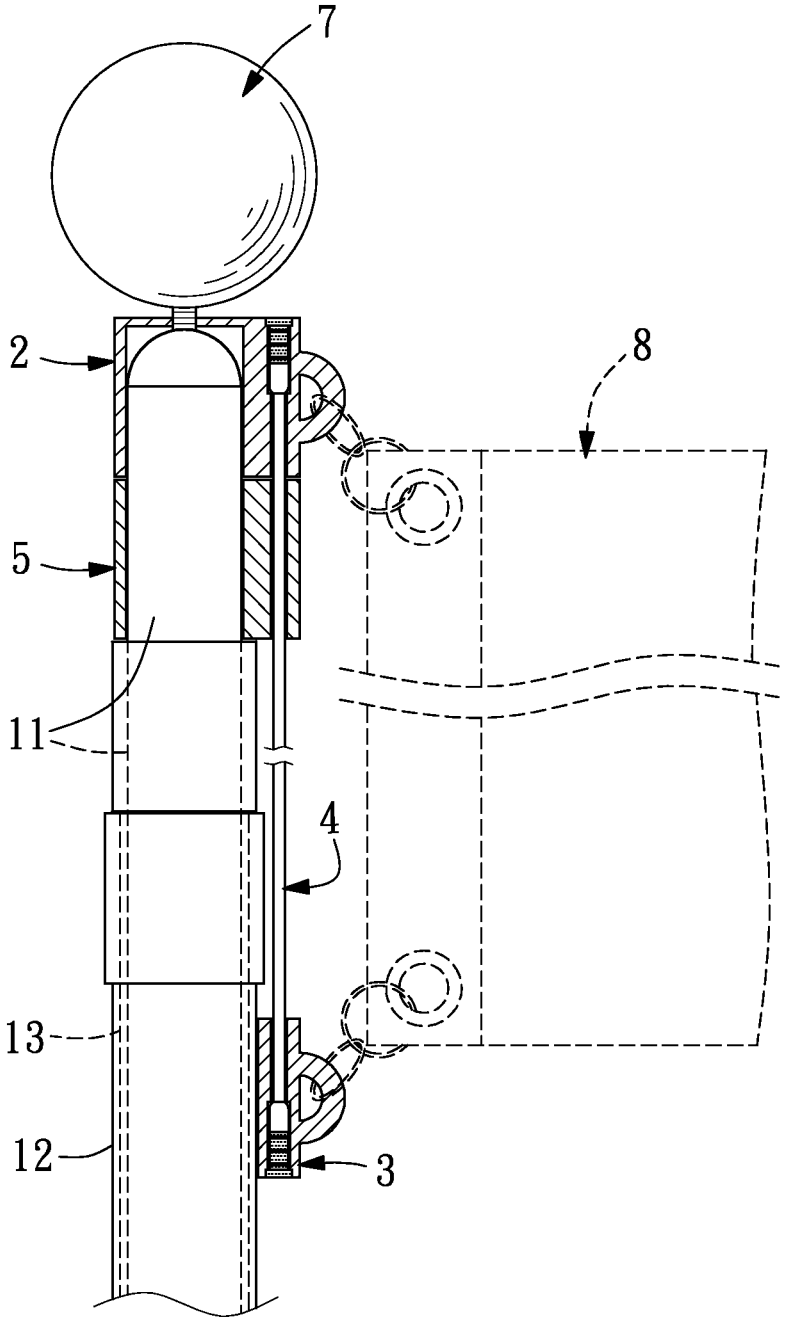
FIG. 6 is a schematic sectional view of the present invention, illustrating the flagpole adjusted from the extended operative condition to the received non-operative condition.

As stated above, the link 4 is coupled between the top pivot holder 2 and the end block 3, the top pivot holder 2 and the end block 3 can be rotated relative to the flagpole 1 synchronously during application (see FIG. 3), therefore, when the flag 8 is flying in the breeze, the top pivot holder 2 and the end block 3 can be rotated relative to the flagpole 1 synchronously, preventing the flag 8 from tangling. Further, the lower pivot holder 5 is coupled to the link 4 and axially movable along the link 4 relative to the flagpole 1 between the top pivot holder 2 and the end block 3 (see FIG. 4). Thus, when extending out the retractable flagpole 1 from a received non-operative condition to an extended operative condition or retracting it from the extended operative condition to the received non-operative condition, the lower pivot holder 5 will be stopped by the top pivot holder 2 or the end block 3 (see FIG. 4 and FIG. 6), and the flag 8 is kept secured to the top pivot holder 2 and the end block 3. Thus, the user can roll up the flap 8 on the flagpole 1 conveniently after the retractable flagpole 1 is set in the received non-operative condition.

Figure 7:
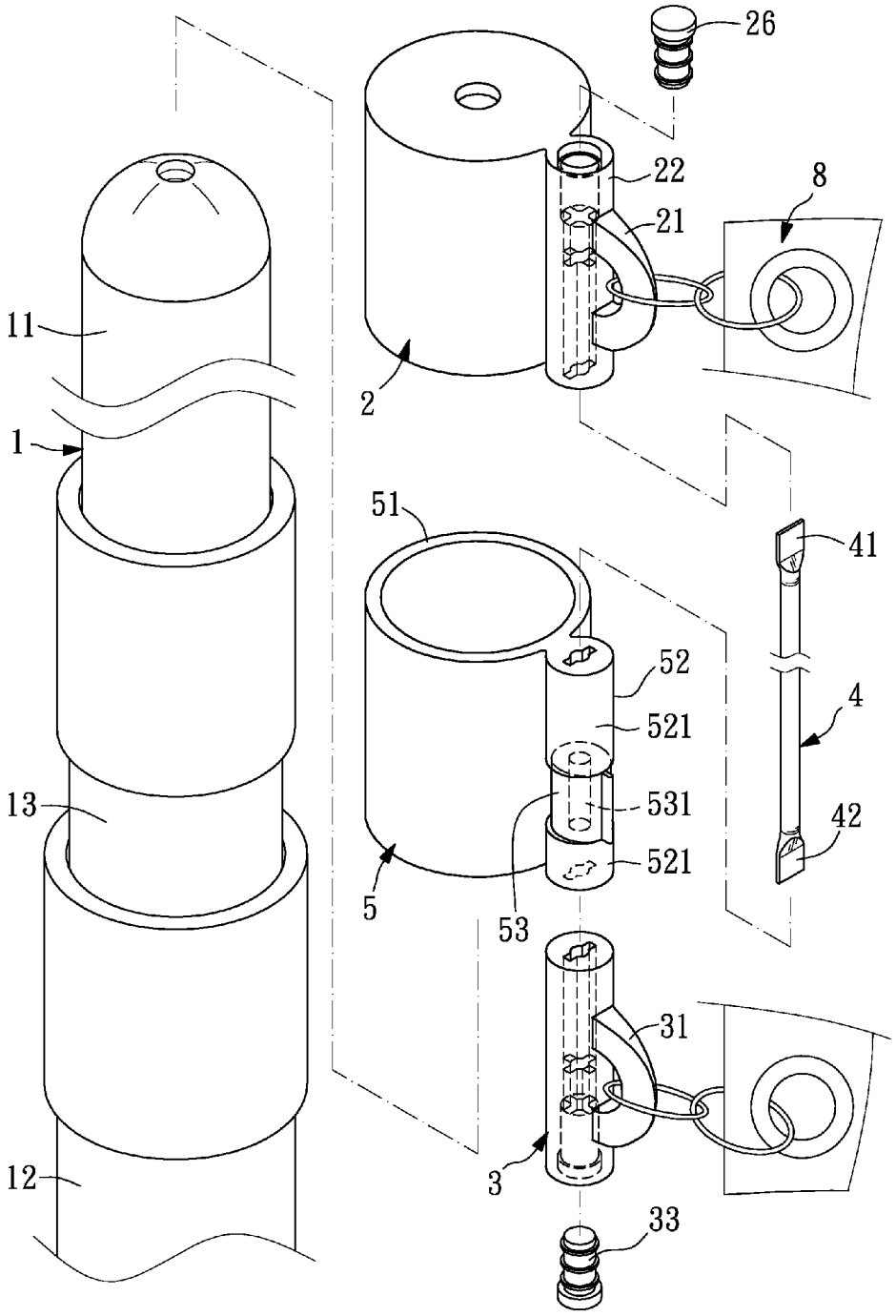
FIG. 7 is a schematic exploded view of a part of an alternate form of the retractable flagpole assembly in accordance with the present invention.
Figure 8:
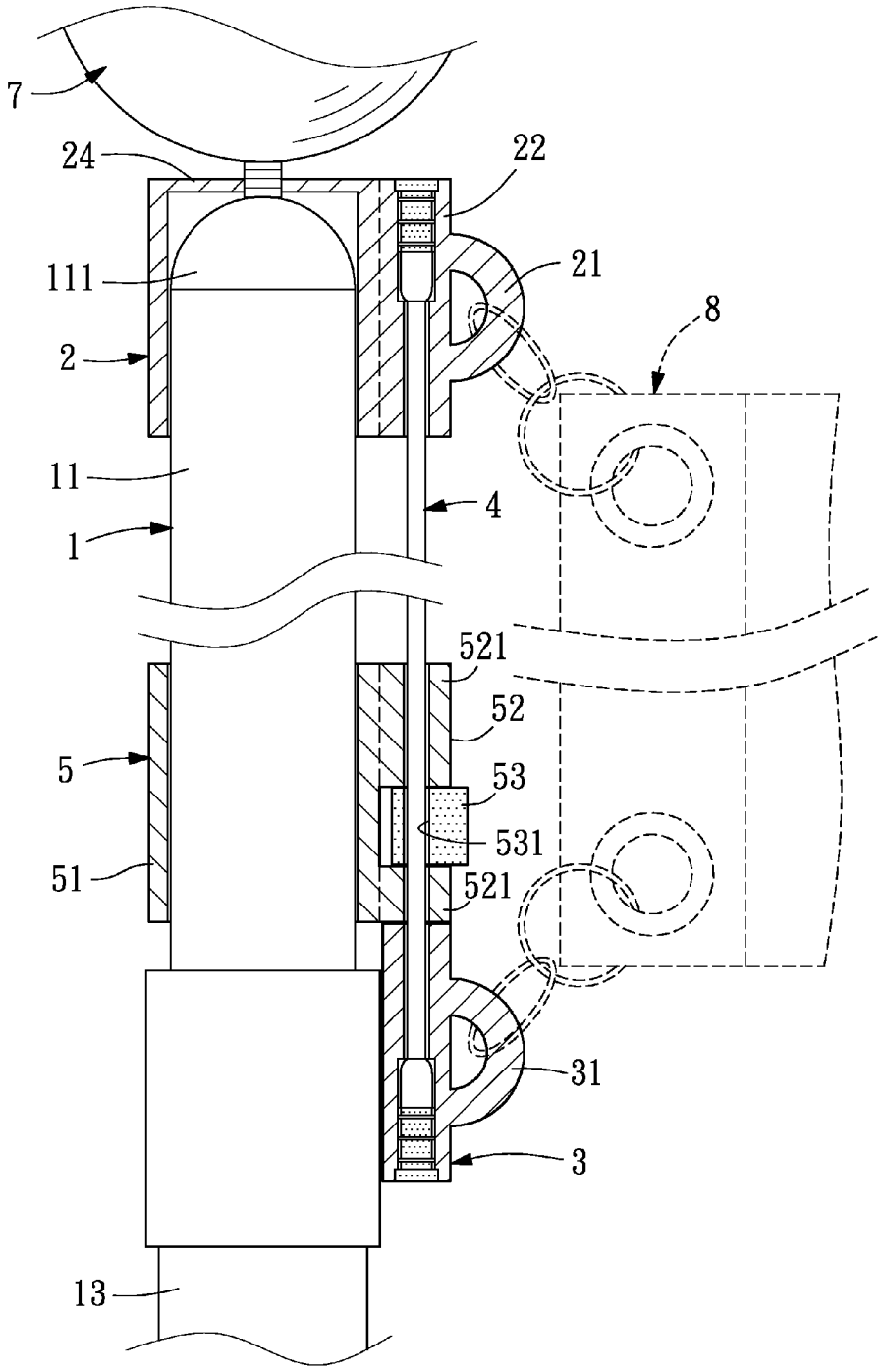
FIG. 8 is a schematic sectional assembly view of a part of the retractable flagpole assembly shown in FIG. 7.
Figure 9:
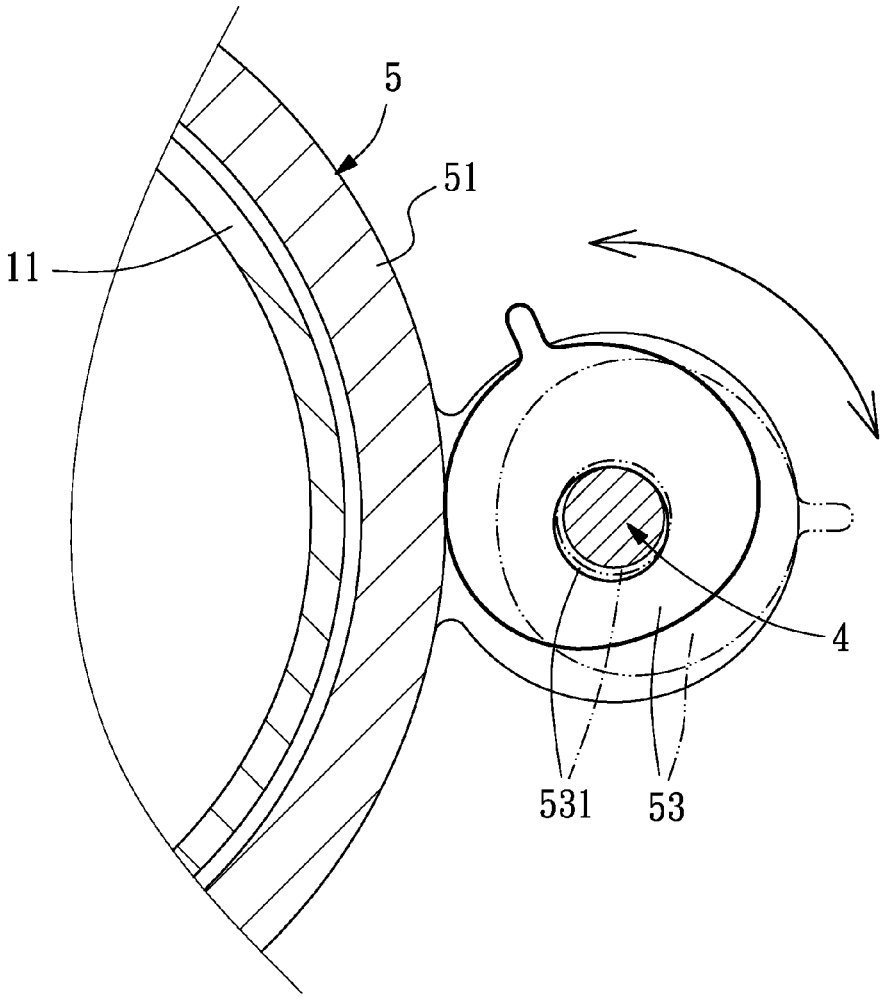
FIG. 9 is a schematic drawing of a part of the retractable flagpole assembly shown in FIG. 7, illustrating the movable sleeve component of the axle sleeve of the lower pivot holder rotated relative to the fixed sleeve components.
Figure 10:
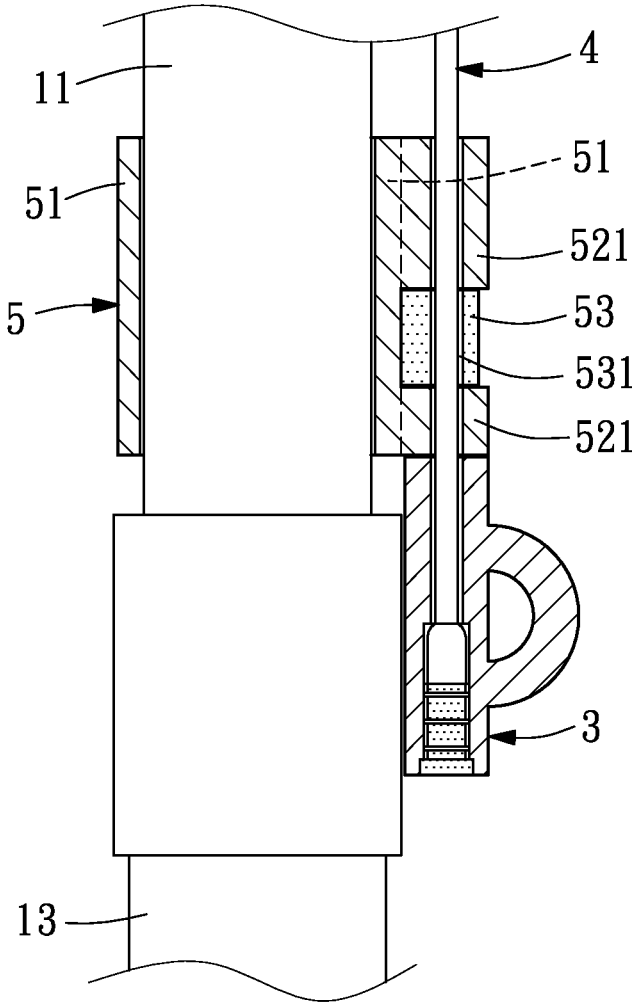
FIG. 10 is a schematic drawing of a part of the retractable flagpole assembly shown in FIG. 7, illustrating the movable sleeve component of the axle sleeve forced into engagement with the link and the periphery of the tubular body of the lower pivot holder.

FIGS. 7 and 8 illustrate an alternate form of the lower pivot holder 5. According to this alternate form, the axle sleeve 52 of the lower pivot holder 5 comprises two fixed sleeve components 521 fixedly connected to the periphery of the tubular body 51 at different elevations and axially aligned, and a movable sleeve component 53 rotatably coupled between the two fixed sleeve components 521. The movable sleeve component 53 comprises an eccentric hole 531 extending through opposing top and bottom ends thereof. The link 4 is inserted through the eccentric hole 531 of the movable sleeve component 53. After insertion of the link 4 through the fixed sleeve components 521 and the eccentric hole 531 of the movable sleeve component 53, the movable sleeve component 53 is rotated through an angle relative to the fixed sleeve components 521 to force the inside wall of the movable sleeve component 53 against the link 4. At this time, the periphery of the movable sleeve component 53 is forced into friction engagement with the tubular body 51 (see FIGS. 9 and 10), and therefore the lower pivot holder 5 is locked to the link 4, allowing the lower pivot holder 5 to be moved with the top pivot holder 2, the end block 3 and the link 4 relative to the retractable flagpole 1 synchronously.

Figure 11:
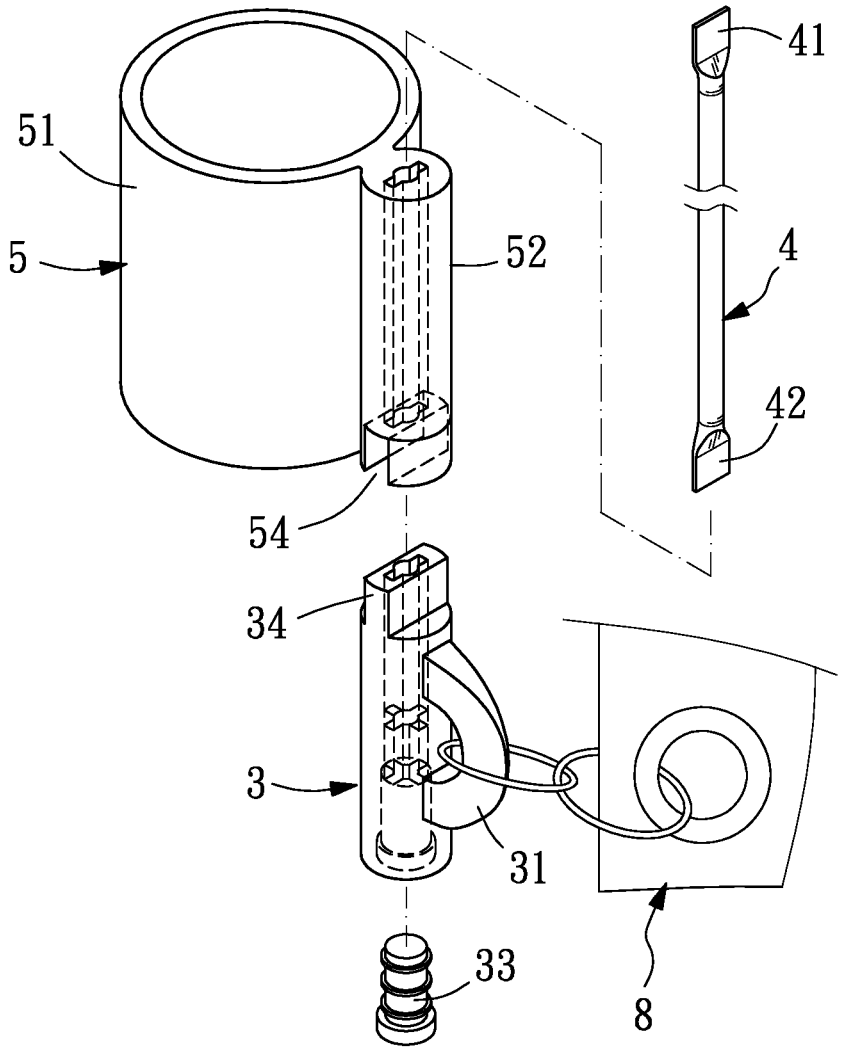
FIG. 11 is a schematic perspective exploded view of a part of another alternate form of the present invention.
Figure 12:
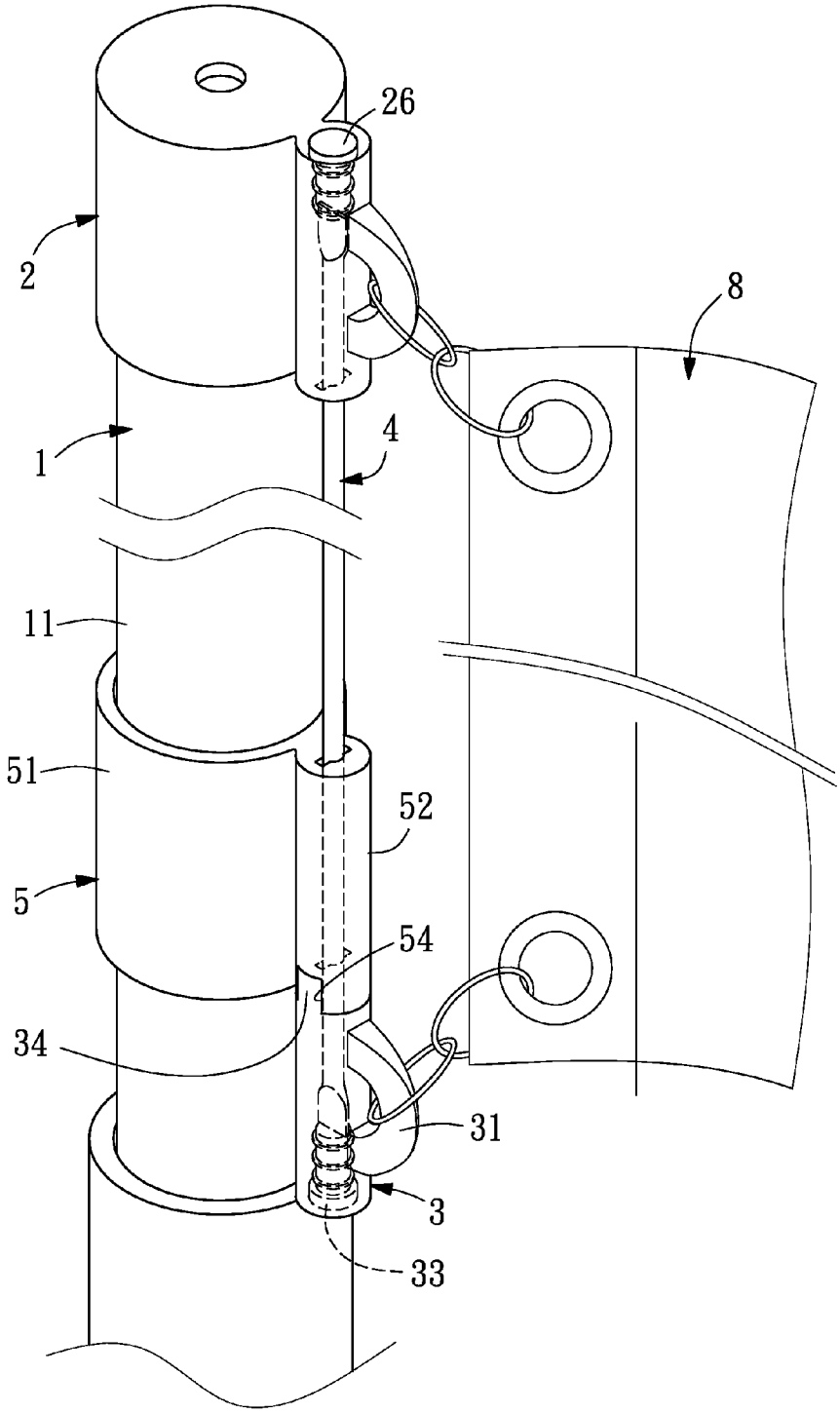
FIG. 12 is a perspective assembly view of the alternate form shown in FIG. 11.
Figure 13:
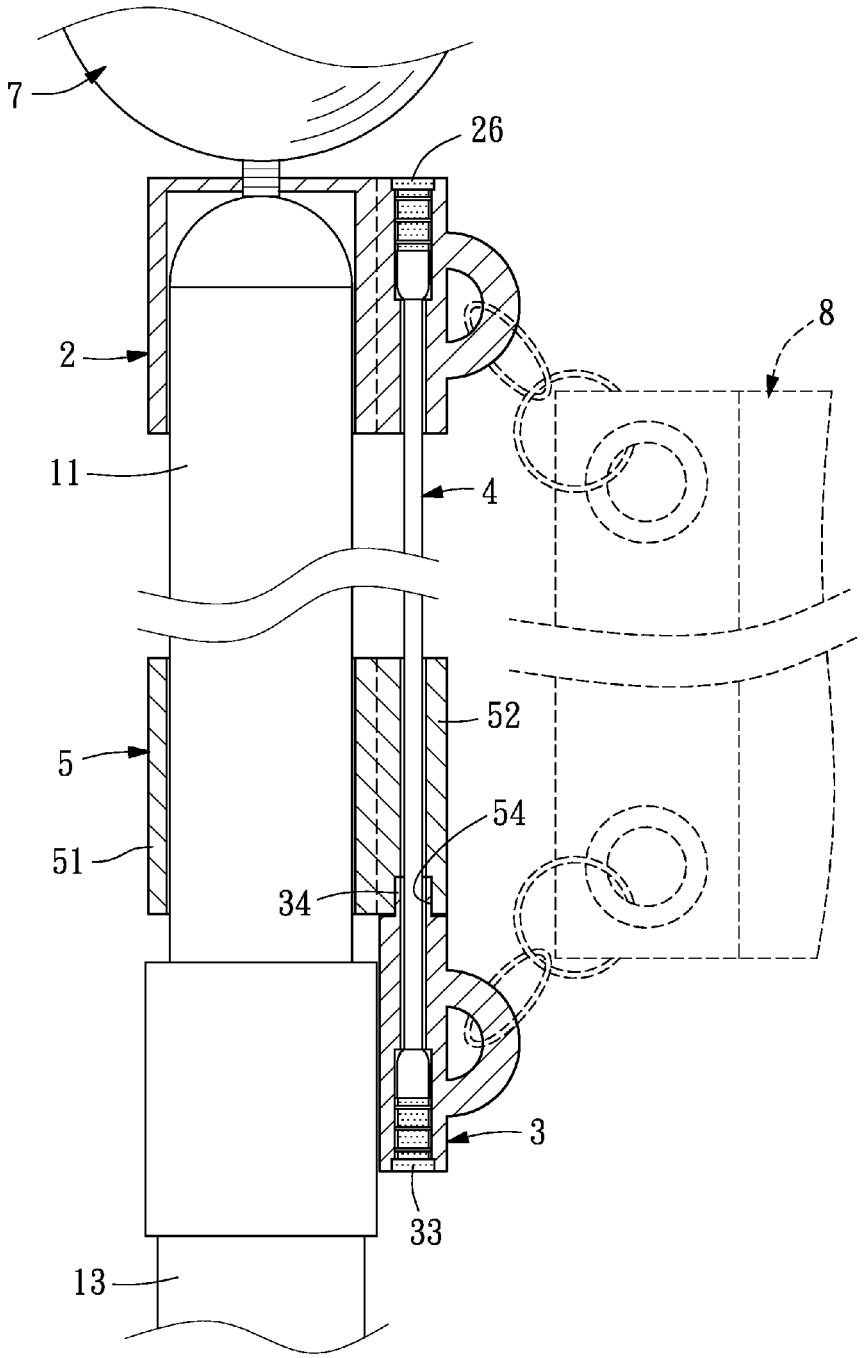
FIG. 13 is a sectional view of the structure shown in FIG. 12.

FIG. 11 illustrates another alternate form of the present invention, which enables the lower pivot holder 5 to be moved axially up and down relative to the link 4 and turned with the top pivot holder 2, the end block 3 and the link 4 about the retractable flagpole 1 synchronously. According to this alternate form, a female coupling portion 54 (for example, coupling groove) is located on the bottom end of the lower pivot holder 5, and a male coupling portion 34 (for example, coupling block) is located on the top end of the end block 3 and detachably engageable into the female coupling portion 54. Thus, when moving the lower pivot holder 5 downwardly along the retractable flagpole 1 toward the end block 3, the female coupling portion 54 can be forced into engagement with the male coupling portion 34 (see FIGS. 12 and 13) to lock the top pivot holder 2, the lower pivot holder 5, the end block 3 and the link 4 together. When unlocking the lower pivot holder 5 from the end block 3 and the link 4, move the lower pivot holder 5 upwardly to disengage the female coupling portion 54 from the male coupling portion 34. Further, when released the lower pivot holder 5 from the hand, the lower pivot holder 5 will be forced by its gravity to move downwardly into engagement with the end block 3. Further, snap, buckle or any of a variety of other fastening means may be used to substitute for the male coupling portion 34 and the female coupling portion 54 for detachably locking the lower pivot holder 5 and the end block 3 together.

By means of moving the lower pivot holder 5 to force the female coupling portion 54 into engagement with the male coupling portion 34 or to disengage the female coupling portion 54 from the male coupling portion 34, the lower pivot holder 5 can be conveniently locked to or unlocked from the end block 3. Thus, when pulled the top rod 11 out of the intermediate rod 13 and the bottom rod 12 to extend out the retractable flagpole 1, the lower pivot holder 5 is then forced into engagement with the end block 3. At this time, the lower pivot holder 5 can be turned with the top pivot holder 2, the end block 3 and the link 4 about the retractable flagpole 1 synchronously, preventing the flag 8 from tangling on the retractable flagpole 1. When the lower pivot holder 5 is disengaged from the end block 3, the lower pivot holder 5 can be moved axially relative to the link 4, allowing the top rod 11 to be received with the intermediate rod 13 into the inside of the bottom rod 12. Briefly speaking, the lower pivot holder 5 can be locked to the end block 3 and the link 4, preventing the flag 8 from tangling on the retractable flagpole 1. When unlocked the lower pivot holder 5 from the end block 3, the retractable flagpole 1 can be received from the extended operative condition to the received non-operative condition.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A retractable flagpole assembly comprising:

a retractable flagpole comprising a top rod, a bottom rod and at least one intermediate rod axially coupled between said top rod and said bottom rod for allowing said retractable flagpole to be alternatively set between an extended operative condition and a received non-operative condition;

a top pivot holder rotatably capped on said top rod of said retractable flagpole, said top pivot holder comprising a first hanging lug for securing an inner top end of a flag;

an end block comprising a second hanging lug for securing an inner bottom end of the flag while the inner top end of the flap has been secured to said first hanging lug of said top pivot holder;

a link connected between said top pivot holder and said end block; and a lower pivot holder being rotatably, movably and axially sleeved onto said retractable flagpole and axially movable along said link and detachably engageable with said end block which is disposed at a bottom side relative to said lower pivot holder.

2. The retractable flagpole assembly as claimed in claim 1, wherein said top pivot holder comprises an axle sleeve vertically disposed at one lateral side thereof, said axle sleeve comprising an axial through hole extending through opposing top and bottom ends thereof, the axial through hole of the axle sleeve of said top pivot holder comprising an upper crossed hole portion, a lower flat hole portion and a stop edge defined between said upper crossed hole portion and said lower flat hole portion; said link comprises a flat top end portion vertically upwardly inserted through the axial through hole of the axle sleeve of said top pivot holder and stopped at a top side of the stop edge of the axle sleeve of said top pivot holder after a rotary motion of said link relative to said top pivot holder.

3. The retractable flagpole assembly as claimed in claim 2, wherein said top pivot holder further comprises an upper end plug plugged in the upper crossed hole portion of the axial through hole of the axle sleeve thereof.

4. The retractable flagpole assembly as claimed in claim 3, wherein said end block comprises an axial through hole extending through opposing top and bottom ends thereof, the axial through hole of said end block comprising a lower crossed hole portion, an upper flat hole portion, and a stop edge defined between said lower crossed hole portion and said upper flat hole portion; said link further comprises a flat bottom end portion vertically upwardly inserted through the axial through hole of said end block and stopped at a bottom side of the stop edge of said end block after a rotary motion of said link relative to said end block.

5. The retractable flagpole assembly as claimed in claim 4, wherein said end block further comprises a lower end plug plugged in the lower crossed hole portion of the axial through hole thereof.

6. The retractable flagpole assembly as claimed in claim 5, further comprising an anchor, said anchor comprising a round tube fastened to a bottom end of said retractable flagpole, an angle plate fixedly fastened to a bottom end of said round tube and terminating in a pointed portion for fastening into the ground, and a force-applying portion perpendicularly extended from an upper part of said angle plate for operation.

7. The retractable flagpole assembly as claimed in claim 5, wherein said lower pivot holder comprises a tubular body sleeved onto said retractable flagpole, and locking means adapted to lock said link to said tubular body.

8. The retractable flagpole assembly as claimed in claim 7, wherein said locking means comprises two fixed sleeve components fixedly connected to the periphery of said tubular body at different elevations and sleeved onto said link, and a movable sleeve component coupled between said two fixed sleeve components and sleeved onto said link and rotatable relative to said two fixed sleeve components and said link between a locking position to lock said link to said tubular body and an unlocking position for allowing said lower pivot holder to be moved axially relative to said link.

9. The retractable flagpole assembly as claimed in claim 8, wherein said movable sleeve component comprises an eccentric hole extending through opposing top and bottom ends thereof for the passing of said link; said movable sleeve component is forced into friction engagement with the periphery of said link and the periphery of said tubular body when moved to said locking position.

10. The retractable flagpole assembly as claimed in claim 5, further comprising a first coupling means located on a bottom end of said lower pivot holder, and a second coupling means located on a top end of said end block and detachably engageable with said first coupling means.

11. The retractable flagpole assembly as claimed in claim 10, wherein said first coupling means comprises at least one coupling groove; said second coupling means comprises at least one coupling block detachably engageable with said at least one coupling groove.

12. The retractable flagpole assembly as claimed in claim 10, wherein said first coupling means comprises at least one coupling block; said second coupling means comprises at least one coupling groove detachably engageable with said at least one coupling block.

* * * * *